United States Patent [19]

Murzin et al.

[11] 4,326,625

[45] Apr. 27, 1982

[54] TRANSVERSE CONVEYOR FOR CONVEYING PIN-SHAPED WORK PIECES IN A MULTI-STATION

[75] Inventors: Horst Murzin; Rainer Wöss; Hans Burghoff; Frank Schmieder; Alfred Herzig; Johannes Junge, all of Karl-Marx-Stadt; Gunter Deckarm, Limbach-Oberfrohna, all of German Democratic Rep.

[73] Assignee: VEB Kombinat Walzlager und Normteile, Karl-Marx-Stadt, German Democratic Rep.

[21] Appl. No.: 158,853

[22] Filed: Jun. 12, 1980

[30] Foreign Application Priority Data

Jun. 13, 1979 [DD] German Democratic Rep. ... 213584

[51] Int. Cl.[3] ..... B65G 25/00; B65G 37/00; B65G 47/84

[52] U.S. Cl. ..... 198/653; 198/486; 198/489

[58] Field of Search ..... 198/486, 489, 773, 777, 198/653, 696

[56] References Cited

U.S. PATENT DOCUMENTS

| | | | |
|---|---|---|---|
| 2,166,381 | 7/1939 | Taylor | 198/696 |
| 2,408,599 | 10/1946 | Bennett | 198/696 |
| 2,888,131 | 5/1959 | Allen | 198/696 |
| 3,954,164 | 5/1976 | Bottomley | 198/486 |

FOREIGN PATENT DOCUMENTS

| | | | |
|---|---|---|---|
| 529973 | 12/1954 | Belgium | 198/486 |
| 1527476 | 5/1970 | Fed. Rep. of Germany | 198/653 |

*Primary Examiner*—Robert B. Reeves
*Assistant Examiner*—Brian Bond
*Attorney, Agent, or Firm*—Jordan and Hamburg

[57] ABSTRACT

A transverse conveyor for a multi-station processing system for pin-shaped workpieces, includes a plurality of pivoted swivel arms, a pair of gripper arms being pivoted to each swivel arm. The pairs of gripper arms have mutually engaging teeth for coupling motion therebetween, and springs are provided to bias the arms closed. The swivel arms are intercoupled for mutual pivoting about their respective axes. The gripper arms are mounted for movement between pairs of adjacent processing stations. One of the gripper arms of each pair is coupled to a roller positioned to engage a circular guide, and the guide is on a pivoted lever whose displacement is controlled by a rotary cam. The rotary cam is shaped to hold the circular guide away from the roller except when the gripper arms are to be opened.

6 Claims, 3 Drawing Figures

TRANSVERSE CONVEYOR FOR CONVEYING PIN-SHAPED WORK PIECES IN A MULTI-STATION

BACKGROUND OF THE INVENTION

The invention relates to a transverse conveyor for conveying of pin-shaped workpieces on machines having a plurality of working stations. The stations may be arranged in a vertical plane, such as, for example, on multiple-step presses. The transverse conveyor has tong-shaped gripper arms, the arms being mounted to execute a transverse movement in order to pass the workpiece from one processing station to the next. A back movement is provided for the return of empty gripper-arms. The arms also execute closing and opening movements for gripping and releasing the workpieces.

Transverse conveyor devices for multistep presses are known. In one known device, a plurality of gripper pairs are mounted on a carrier plate to have a translatory movement between processing steps. This results in large mass moments of inertia, leading to great wear of the movable parts. Precision in the setting of the final positions of the device can be obtained only within limits, so that the overall efficiency of the device is impaired.

In some known transverse conveyor devices, this disadvantage of large moments of inertia is prevented by an arrangement employing a plurality of coupled pivotable levers. In this arrangement, though it is not possible to use the well known transverse conveyor tongs having gripper-arms that open and close at periodically repeating time intervals. Such gripper-arms are operated by a motion control mechanism and the opening and closing movements of both gripper-arms of each set are intercoupled. This arrangement is described, for example, in DE-OS No. 2,813,108.

The above conveyor devices have rigid gripper-arms which can only perform a kind of "snapping function". This is disclosed in DE-OS No. 2,148,529, DE-AS No. 1,272,687, DE-AS No. 1,271,516 and U.S. Pat. No. 3,022,526.

The above transverse conveyor devices are limited for use only with parts that correspond to the construction of the conveyor means. The output of the multistep press is mainly a function of the potential efficiency of the grippers. It is impossible to make the above described transverse conveyor device dependent on the rhythm of the press process, and the gripper-parts are subject to extraordinary wear.

Prior solutions, having a combination of an arrangement with low inertia forces and enabling forced opening and closing of the gripper pairs, are so complicated that a greater output cannot be obtained. The transport of workpieces, which up to now use a fraction of the time needed for a turn of a crankshaft, is a characteristic criterium for the increase of the number of press cycles and for improved utilization of multistep presses.

SUMMARY OF THE INVENTION

It is therefore the object of this invention to provide a transverse conveyor device enabling increased speeds in the transport of pin-shaped workpieces, so that a considerable increase of output from the press may be obtained, with a higher utilization and the simultaneous reduction to a minimum of inertial forces. The device must also be able to accommodate to varying sizes of blanks, thereby increasing the range of goods that can be handled.

The invention is directed to the provision of a transport device for substantially pin-shaped workpieces, for instance on multistep presses, combining the advantage of pivoting coupled levers with associated grippers with the simple adjustable, preferably cam-regulated motion for the opening of the grippers.

In accordance with the invention, gripper-arm pairs are located in the area of the work stations. The gripper-arm pairs are mounted on a pivot-lever, which pivots around a swivel bearing and directs the movement of the tong-shaped gripper-arm pairs. The gripper-arm pairs are capable of moving around the axis of the swivel bearing in a circular path. A curved cam has the same geometric shape as this circular path and a rolling element, connected to one of the gripper-arms is mounted to roll on this curved cam or guide. When the gripper-arms moved to a position at which they must open, the rolling element is engaged by the curved cam or guide.

The pivotable gripper-arms are actuated by the curved guide, which is a part of a guide lever moved in turn by an opening cam. When the gripper-arms are not open, the shape of the opening cam enables the smallest possible distance between the rolling element and the curved guide. This makes identical opening paths possible.

In order to obtain identical swivel angles of the swivel levers, whose number may coincide with the number of the work stations, the levers are connected by a coupling member. A coupling rod, for transferring the motion of the drive, is mounted at the outer end of one swivel lever, and is adjustable in its longitudinal direction, in the radial sense of the circular motion, to make changes of the swivel angle possible.

BRIEF FIGURE DESCRIPTION

In order that the invention will be more clearly understood, it will now be disclosed in greater detail with reference to the accompanying drawings, wherein.

DETAILED DISCLOSURE

Figure 1:
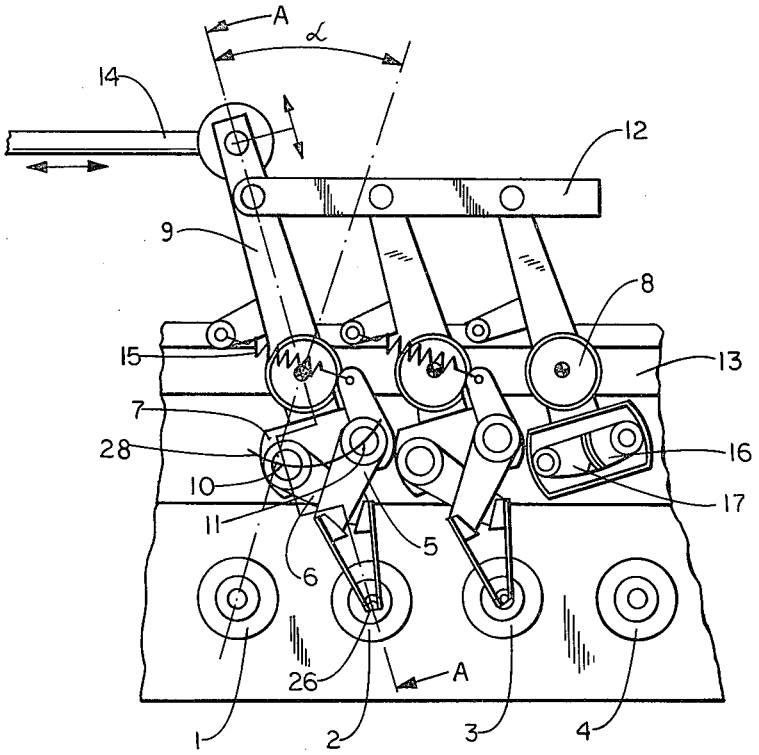
FIG. 1 is a simplified view of the front of a transverse conveyor device in accordance with the invention, on a multistep press.

Referring now to the drawings, therein is shown a device for the transport of workpieces mounted on a press adapted to perform four operations on a workpiece. In order to effect the four operations, four processing stations are provided, and tong-shaped gripper-arm pairs are provided for these processing stations. The gripper arm pairs are comprised of gripper-arms 5 and 6. The gripper-arms 5 and 6 are arranged so that one pair acts between stations 1 and 2, another pair acts between stations 2 and 3, and a third pair acts between respective processing stations 3 and 4.

The gripper-arms 5 and 6 are pivotably mounted on gripper-arm joints 10 and 11 respectively, which are mounted on a carrier plate 7 of a swivel-lever 9. The swivel-lever 9 is pivoted on a swivel bearing 8 for movement through the angle $\alpha$. Depending upon the number of the processing-stations present, several swivel-levers 9 are present. These levers are connected to one another by a common coupling arm 12. The fixed fulcrum for the swivel-bearing 8 is located on a receiving-part 13. A coupling rod 14, disposed at the end of one of the swivel-levers 9 extends to a driving mechanism (not shown). The coupling point of the swivel-lever 9 is capable of radial adjustment in order to vary the swivel angle $\alpha$.

Figure 2:
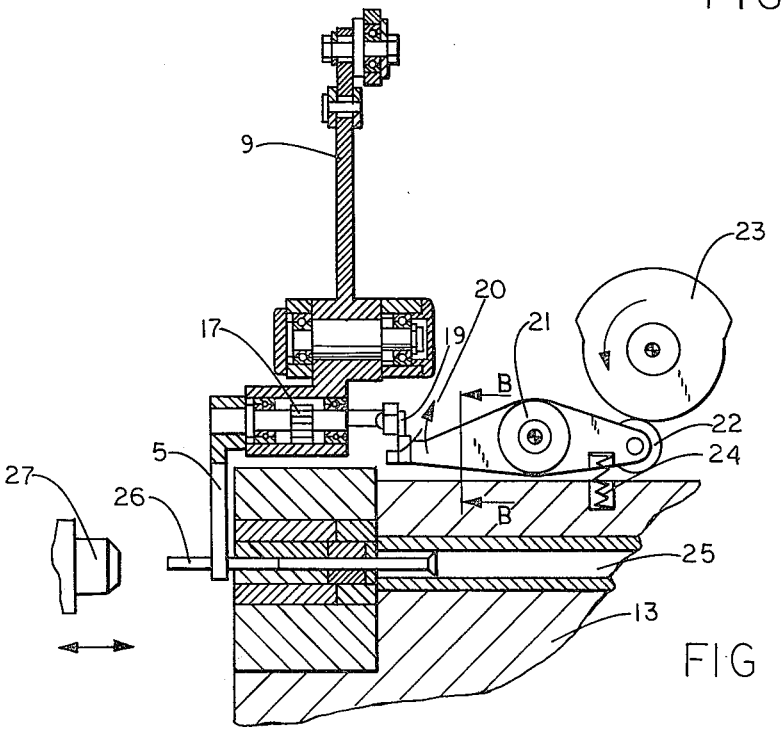
FIG. 2 is a cross sectional view of the device of FIG. 1, taken along the lines A—A.
Figure 3:
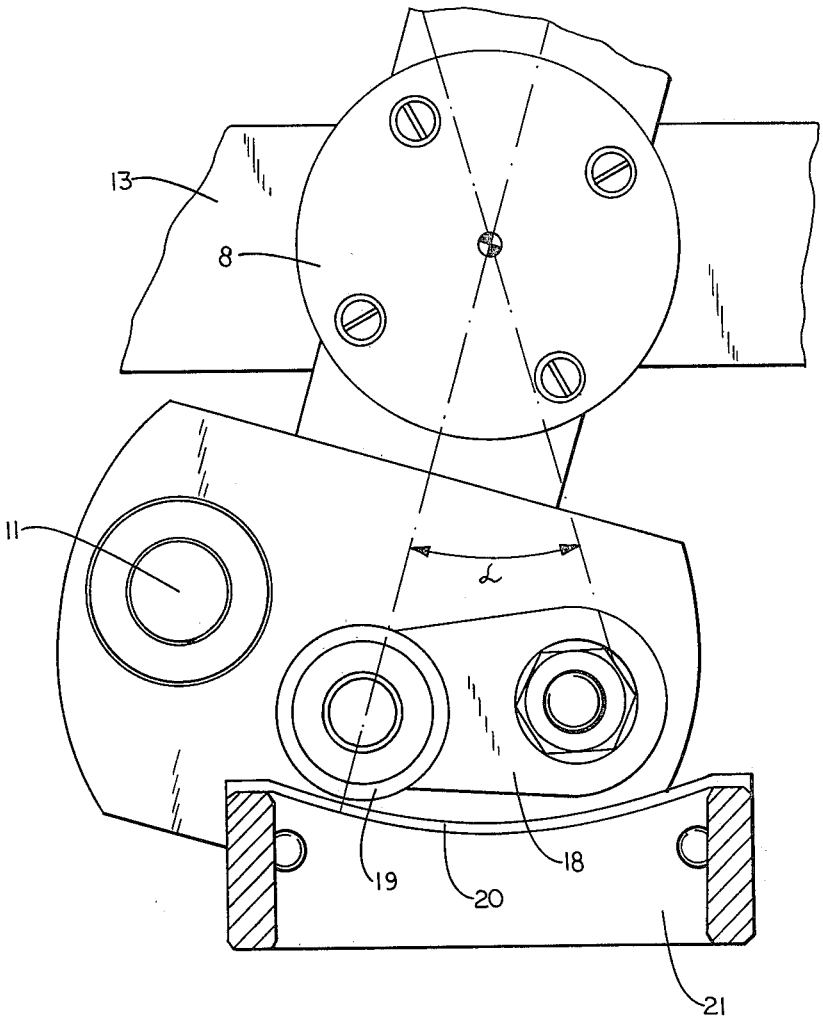
FIG. 3 is an enlarged cross sectional view of a portion of the arrangement of FIG. 2 taken along the lines B—B.

One gripper-arm 5 of each gripper-arm pair is connected to a tension spring 15, the other end of the spring being fastened to the swivel-lever 9. Both gripper-arms 5 and 6 of the gripper-arm pairs have intermeshing toothed segments 16 and 17. The other gripper-arm 6 of the gripper-arm pairs is connected to a roller 19 by way of a transfer-lever 18. The roller 19 engages a curved guide 20 on one end of a pivotted guide-lever 21. A roller 22 on the other end of the lever 21 engages a rotatable cam 23. The roller 22 of guide-lever 21 is biased against cam 23 by means of a pressure-spring 24 extending from the frame 13. A push rod 25 for pushing the blank 26 is located inside the frame 13. As shown in FIG. 2, the rod 25 has a reduced diameter end extending into the guide for engaging the end of the blank. A press-tool 27 is provided for each of the processing stations 1, 2, 3 and 4 for shaping and pressing the workpieces.

A work cycle begins following a pressing operation on a blank 26 in the device simultaneously with the backward movement of the press-tool 27, the movement of the push rod 25 to force the workpiece out of the receiving frame 13, and the closing of the gripper-arms 5 and 6 in front of the processing stations 1, 2, and 3. At this time, opening cam 23 and pressure-spring 15 urge the closing of the gripper-arms 5 and 6 by forcing the gripper-arms 5 and 6 together by means of the toothed segments 16 and 17 and the pressure-spring 15, since toothed segments 16 and 17 are engaged.

During this ejection of the blank by the push rod 25 and the gripping of blank 26 by the gripper-arms, no swivelling motion of the gripper-arm pair occurs. After being gripped, the blank 26 is swivelled towards the processing stations 2, 3, and 4 by the respective gripper-arm pairs. At first the gripper-arm pairs remain closed since the curved guide surface 20 is spaced below the rolling element 19.

As soon as the pressing tool 27 has received the blank 26 at the next respective station, the gripper-arms 5 and 6 are forced to open by the raising of curved cam surface 20 of the guide-lever 21, as a function of the angular displacement of the cam 23.

The curved surface 20 is a circular cam surface for the rolling-element 19, and has such a geometrical shape that it conforms to a circular path 28 around the fulcrum of the swivel-bearing 8, upon which the gripper-arm joints 10 and 11 move through the swivel-angle $\alpha$.

The gripper-arm pairs accordingly are kept open during their movement back to alignment with the processing-stations 1, 2 and 3 respectively. The opening angle of the gripper-arm pairs is sufficiently large that the gripper arm 5 and 6 are capable of swivelling back across the blanks 26 without engaging the blanks.

While the invention has been disclosed and described with reference to a single embodiment, it will be apparent that variations and modifications may be made therein. It is therefore intended in the following claims to cover each such variation and modification as falls within the true spirit and scope of the invention.

What is claimed is:

1. A transverse conveyor device for conveying pin-shaped workpieces from one processing-station to the next processing-station, with gripper-arm pairs allocated to the processing stations, the individual gripper-arms having joints, the opening of said gripper-arm pairs being actuated by a control-mechanism, the gripper arms of each pair being intercoupled for opening and closing motions; the improvement wherein two gripper-arm pivot axes are located on a swivel-lever in the region of the processing-stations the swivel lever is pivoted at a swivel-bearing, said gripper arm pivot axes receive tong-shaped gripper-arm pairs and are movable along a circular path around the axis of the swivel-bearing, a curved-guide is provided having a geometrical shape the same as said circular path and wherein a roller connected to one of said gripper-arms of each pair is positioned to roll on said curved guide, said roller engaging said curved guide only when the respective gripper-arms are open.

2. The transverse conveyor device of claim 1, wherein the curved guide is connected to a pivoted guide-lever, said guide lever being mounted to engage an opening cam.

3. The transverse conveyor device of claim 2, wherein said opening cam is shaped to separate said roller and curved guide as small a distance from each other as possible, except when said gripper-arms are open.

4. The transverse conveyor device of claim 1, wherein the number of swivel levers corresponds to the number of the processing stations, said swivel-levers are connected to one another by a coupling element to enable variation of the swivel angle, and wherein a coupling rod is pivoted at the free end of one of the swivel-levers, said coupling rod having an adjustable radius.

5. In a transverse conveyor multi-station processing system for processing pin-shaped articles, wherein gripper-arm pairs are mounted to pass said articles between adjacent stations, the improvement wherein a plurality of swivel arms are pivotally mounted, connecting means intercoupling said swivel arms for movement through a given angular displacement, the gripper-arms are tong-shaped and are pivoted in pairs on said swivel arms, the gripper-arms of each pair being rotationally intercoupled, spring means coupled to urge the gripper-arms of each pair to a closed position, a circular section cam surface, roller means coupled to one gripper-arm of each pair positioned to engage said cam surface, a pivoted lever means, said cam surface being on said pivoted lever for movement into and out of engagement with said roller, and rotary cam means mounted to control the position of said pivoted lever.

6. The transverse conveyor of claim 5 wherein the pivots of said gripper arms are positioned to move in a circular path with swivelling of said swivel arms, and said circular section cam surface has the same radius of curvature as said circular path.

* * * * *